United States Patent [19]

Thomas et al.

[11] Patent Number: 4,641,599

[45] Date of Patent: Feb. 10, 1987

[54] SPEED MANEUVERING WATER CRAFT AND CONTROLS

[76] Inventors: Charles E. Thomas, 998 E. Main St., #77, El Cajon, Calif. 92020; Richard Harvey, 10828 Buggywhip Dr., Spring Valley, Calif. 92078

[21] Appl. No.: 771,022

[22] Filed: Aug. 30, 1985

[51] Int. Cl.[4] ..... B63B 3/00; B63H 21/165

[52] U.S. Cl. ..... 114/346; 114/270; 440/5

[58] Field of Search ..... 440/1, 3, 5, 71, 113, 440/38; 114/346, 270

[56] References Cited

U.S. PATENT DOCUMENTS

| | | | |
|---|---|---|---|
| 2,058,383 | 10/1936 | Maynes | 114/270 |
| 3,807,343 | 4/1974 | Peebles | 440/1 |
| 3,827,387 | 8/1974 | Morgan | 114/346 X |
| 3,983,833 | 10/1976 | Eickmann | 440/5 |
| 4,367,689 | 1/1983 | Lukehart et al. | 114/346 |

*Primary Examiner*—Sherman D. Basinger

*Assistant Examiner*—Paul E. Salmon

*Attorney, Agent, or Firm*—Charmasson & Holz

[57] ABSTRACT

A highly maneuverable water craft for recreational enthusiasts with two hydraulically controlled and driven reversible propellers directionally fixed to a toroidal peripheral hull section which encircles a thinner interior platform section. The toroidal exterior hull provides stability for the platform in water, allowing the water craft to quickly spin, translate, stop and start. The directionally fixed propellers are not impacted by translation or spin and provide rugged and simplified construction. Placement of two fixed reversible propellers on the peripheral hull section provides maximum turning torque and allows elimination of a rudder or directional actuators. Control is provided by a novel pilot actuator and four-way valves assembly. Bumper strips, propeller guards, handholds and deadman switches can be provided for safety in handling this extremely maneuverable water craft.

6 Claims, 7 Drawing Figures

SPEED MANEUVERING WATER CRAFT AND CONTROLS

FIELD OF THE INVENTION

This invention relates to water craft and more specifically to ship hull and propulsion design. It also relates to hydraulic systems and control valves.

BACKGROUND OF THE INVENTION

In many recreation areas, a popular activity by water recreation enthusiasts is the operation of maneuverable water craft. These craft run the gamut from bumper boats, jet skis, ski boats, skiffs, and other water craft with more conventional designs. The objective of many of these recreational activities requires rapid acceleration and maneuverability of the craft. These craft must be extremely rugged because of the high stresses involved in operation, transport and handling.

Previous propeller driven water craft designs are generally either adaptations of standard ship hull designs with directionally fixed propellers and rudders primarily designed for forward motion, or circular designs with directionally movable propulsion means. The standard hull designs offers rapid acceleration and high speed capability but offers limited maneuverability due to the inability to propel full force in other than forward direction and increased hull resistance to translation. Circular craft offers excellent translation ability but are limited in turning, high speed or rapid acceleration ability due to the stress limitations of the moveable propulsion system and generally unstreamlined and central location of the propulsion system.

Placement and response of propulsion systems in either of the prior designs are constrained by motor transmission, shaft and propeller limitations. Direct drive motor/propeller combinations does not quickly respond to changes in controls due to large inertial forces. Speed control is also limited by minimum speed of the motor and nonlinear controls. Various transmission mechanisms provide additional placement flexibility and may aid speed control but add further weight and inertia, restricting response.

Multiple propeller adaptations of standard hull designs offer improved turning ability without the need for a rudder, but can not translate. Turning torque is also limited by the narrow ship width and response is limited by engine/transmission limitations.

Pilot operated control valves have previously offered fast response without the need for an additional power supply. However prior art designs were generally not compact and rugged, and required significant pilot fluid flow during normal operation conditions.

SUMMARY OF THE INVENTION

The principal and secondary objects of the invention are:

to provide a stable low cost multiple propeller driven water craft capable of high speed translation in any direction;

to obtain a maximum turning torque from a single prime mover in the water craft;

to provide an infinitely controllable, reversible and lightweight means to control the rotational speed of each propeller;

to provide a rugged means to transmit power from one engine to both propellers; and to provide a minimum of power loss required for control.

These and other objects are achieved by directionally fixing two propellers to opposite portions of a donut-shaped hull section and driving these propellers by reversible hydraulic motors. Highly responsive control of these motors is achieved by a control valve assembly consisting of two four-way valves which incorporates in each supply poppet a fixed orifice for supplying a small constant volume pilot fluid to infinitely variable orifices allowing rapid response pressure changes.

The fixed propellers and donut-shape provide rugged construction allowing translation in any direction. Diametrically opposite placement of the reversible propellers provides a maximum turning torque. The hydraulic motors provide direct coupling and continuously controllable propeller speed, allowing one motive force engine to drive both propellers. The constant speed pumps and four-way valves provide simple and lightweight control means while the fixed orifices allow fast response with minimim loss of full speed power.

DESCRIPTION OF THE PREFERRED EMBODIMENT

Figure 1:
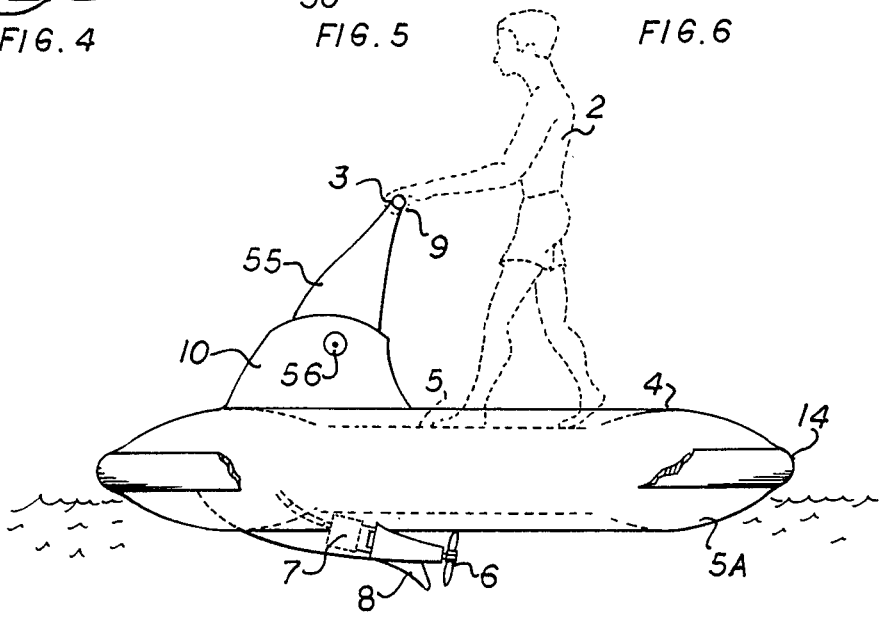
FIG. 1 is a side view of the water craft.

Referring now to the drawings, FIG. 1 shows a side view of a speed maneuvering water craft. The water craft is designed for a standing enthusiast-operator 2 holding on to a handlebar 3. The hull 4 is generally formed by a circular platform 5 expanding about its edge into a toroidal frame forming a bulbous outer hull portion 5A, a concave top surface and a wetted bottom surface also generally concave in shape and generally symmetrical to the top surface. The vertical cross section of the hull is generally elliptical. One of the two identical propellers 6 is shown attached to the bulbous outer portion 5 at nearly opposite points of one of the semiaxis of the elliptical hull 4. Driving the propeller 6 is a hydraulic motor 7 shown in outline. A propeller guard 8 is provided to protect propeller or enthusiast in the water.

Figure 2:
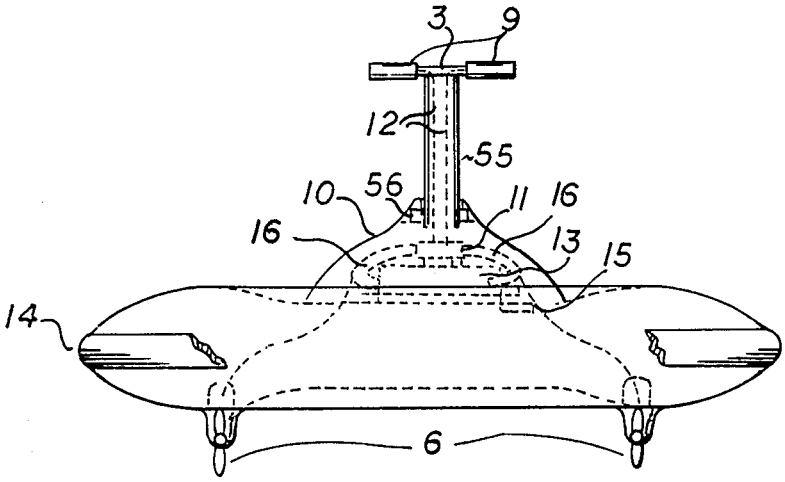
FIG. 2 is a rear view of the water craft.

FIG. 2 shows a rear view of the same speed maneuvering water craft. Mounted on handlebar 3 are two grip controls 9. The handlebar 3, is mounted on a support structure and engine housing 10. Twist grip controls are connected to a hydraulic control valve 11 by cables 12. An alternate configuration is to mount the hydraulic control valve 11 on handlebar 3. Directly connected to grip controls 9, eliminating cables 12 but requiring additional lines 16. The support structure and engine housing 10 provides environment protection for the cables 12, hydraulic control valve 11 and internal combustion engine/hydraulic pumps assembly 13. The support structure and engine housing 10 is attached to the interior and exterior portions of the hull 4 and 5. Housing 10 may also be pivoted (not shown for clarity)

to allow enthusiast to kneel. A pliant bumper guard 14 is attached to the outboard portions of the hull 4 to prevent damage or injury. A deadman switch 15 is provided underneath enthusiast 2 to stop ignition of the engine 13 if enthusiast is thrown from the craft. Hydraulic lines 16 connect pumps 13 to control valve 11 to hydraulic motors 7. An alternate control scheme is to also connect the engine 13 throttle to a plunger actuated by control valve 11.

Figure 3:
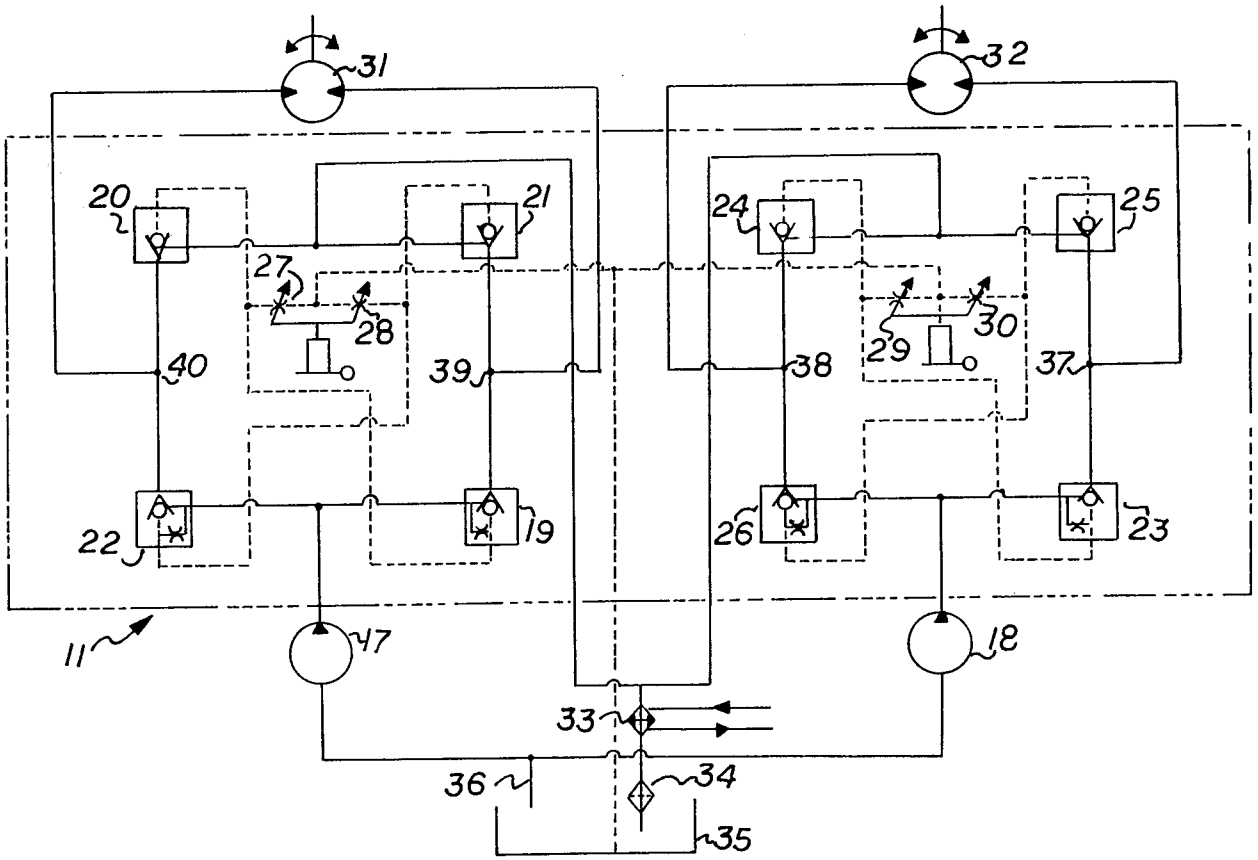
FIG. 3 is a schematic diagram of the hydraulic system.
Figure 7:
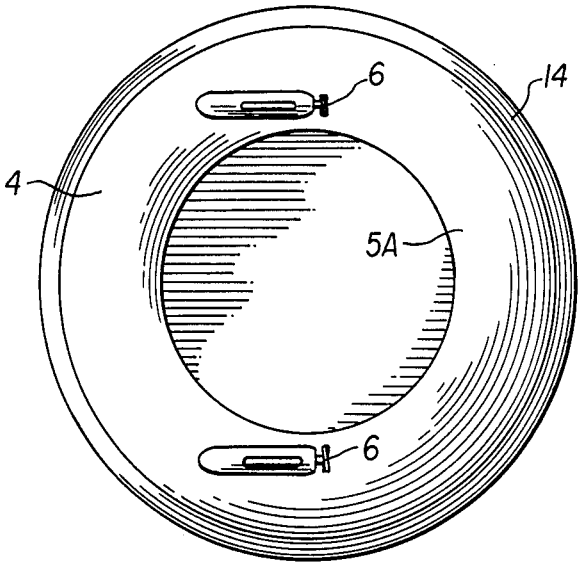
FIG. 7 is a bottom plan view of the water craft shown on a reduced scale.

FIG. 3 is a hydraulic schematic. Two identical hydraulic pumps 17 and 18 are driven by an internal combustion engine (not shown for clarity). Hydraulic fluid flow from pumps 17 and 18 is transferred to the control valve 11 shown only in outline for clarity. The hydraulic fluid enters two identical four-way valves, which each comprise 2 sets of supply and discharge poppet valves 19 through 26. Supply poppet valves 19, 22, 23 and 26 include an integral restricted bypass to the pilot actuation system (shown in dashed lines). Fluid in the pilot actuation system is discharged through two sets of paired variable orifices 27 through 30. If the first variable orifice 27 is restricted, oil pressure in the portion of the pilot actuation system from poppets 19 and 20 is increased, tending to close the second supply poppet 19 and the first discharge poppet 20. In addition to the closing control functions of the poppets, they also function as relief valves.

When variable orifice 27 is restricted and variable orifice 28 remains open, oil pressure in the portion of the pilot actuation system from poppets 21 and 22 is decreased tending to open the first supply poppet 22 and the second discharge poppet 21. This allows oil to tend to turn the first hydraulic motor rotor 31 in one direction. The discharge from the hydraulic motor rotor in this condition is passed by the open second discharge poppet 21 through a return in common with discharges from the second hydraulic motor rotor 32 to a cooling heat exchanger 33 and filter 34 before returning to reservoir 35. A suction line 36 is branched to supply oil to constant speed pumps 17 and 18.

By alternately opening and restricting each pair of variable orifices, either 27 and 28 or 29 and 30, reversible hydraulic motors can be turned in either direction. By partially restricting each pair of variable orifices the respective poppets, acting as relief valves, will limit the oil flow and pressure to the reversible hydraulic motors to give highly responsive part load/speed operation.

Figure 4:
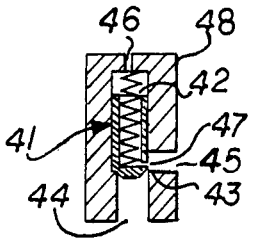
FIG. 4 is a respresentative poppet valve with fixed orifice.

FIG. 4 illustrates a representative supply poppet valve with a fixed orifice bypass. The poppet 41 is biased by spring 42 towards seat 43. Main fluid flow and pressure between ports 44 and 45 is controlled by the position of poppet 41. Position of poppet 41 is a function of the pressure difference between the pilot actuation system at pilot port 46 and main fluid pressure, and the spring 42 force on poppet 41.

In order to obtain an initial charge of oil or recharge the hydraulic lines between opposing sets of supply and discharge poppets interconnection points 37 through 40, fluid from the pumps 17 and 18 acting on the periphery of poppet 41 at seat 43 will open poppet 41 to fill or recharge system.

Fixed restriction passage 47 allows a small amount of fluid from port 45 to supply the pilot actuator system. A representative discharge poppet valve cross-section would be similar, except that restriction 47 would not be drilled. If the restriction passage was a helical groove (not shown for clarity), valve operation would be independent of poppet position.

Figure 5:
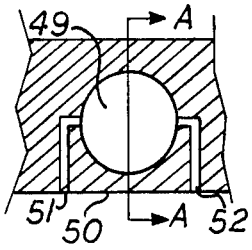
FIG. 5 is a cross-section of a variable orifice valve.

FIG. 5 shows a cross-section of a paired variable orifices. The orifices consists of a cylindrical cavity 49 in variable orifice body 50 with two orifice ports 51 and 52 drilled in variable orifice body 50.

Figure 6:
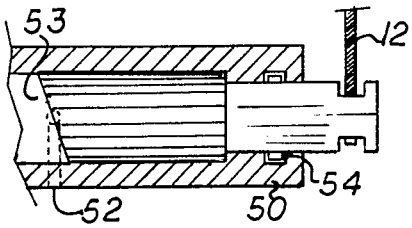
FIG. 6 is a section A-A view of a variable orifice valve.

FIG. 6 is a section A-A shown in FIG. 5. It shows a rotating truncated right circular cylinder 53 in body 50 which can expose or partially close either orifice ports 51 and 52 but cannot close both orifice ports 51 and 52 at the same time. Rotation of the cylinder 53 can be accomplished by cables 12 or by hand. Fluid sealing is accomplished by elastomeric O-ring 54. A rotational bias spring on twist grip controls 9 of cylinders 53 (not shown for clarity) is used to return cylinder to neutral position (shown) when enthusiast is not exerting rotational force. This safety feature stops the craft if the enthusiast is thrown allowing enthusiast to easily return and recover the craft.

The handlebar 3 may be connected to the engine housing 10 by a stem 55 rotating about the axis 56 in order to allow the operator to operate the craft from a standing, kneeling or crouching position. Although only the preferred embodiment of the invention has been described in a particular application, other embodiments and applications may be devised without departing from the spirit of the invention and the scope of the appended claims.

What is claimed is:

1. A speed maneuvering water craft for the water recreation enthusiast which comprises a generally circular platform expanding about its edge into a toroidal frame to form concave and generally symmetrical top and bottom surfaces; means for propelling said craft, comprising: two rotating shafts mounted in a directionally fixed and generally horizontal position at diametrically opposite locations under said frame; a reversible propeller mounted on each of said shafts; and means for rotating said shafts independently from each other; two hydraulic motors, each driving one of said shafts; two hydraulic pumps, each supplying fluid to one of said motors; an internal combustion engine driving said pumps; independent means, for controlling each of said hydraulic pumps, comprising: a handlebar having two twist grip control handles; two throttle control valves each one of said valves being linked and responsive to one of said handles; wherein each of said throttle control valves comprises: two supply poppet valves each receiving pressurized fluid from one of said hydrualic pumps and discharging to two interconnection points; two supply/discharge conduits for fluid connected between said interconnection points and two reversible supply and discharge ports of one of said hydraulic motors; two discharge poppet valves each receiving said hydraulic motor discharge fluid from said interconnection points and returning said fluid to the suction of said hydraulic pump; and a pilot actuation system means of actuating alternate pairs of said supply and discharge valves so that said pressurized fluid is supplied to one of said reversible supply and discharge ports and said hydrualic motor discharge fluid from said other reversible supply and discharge port is relieved to said suction of said hydraulic pump.

2. The water craft claimed in claim 1 wherein said supply poppet valve comprises:

a poppet;

a supply poppet valve body containing said poppet;

a supply port connected to said pressurized fluid in said supply poppet valve body leading to said poppet;

a feed port connected to said interconnection port in said supply poppet valve body leading to said poppet in a manner wherein pressure in said feed port would tend to open said poppet;

a pilot actuation port connected to said pilot actuation system means in said supply poppet valve body leading to said poppet in a manner wherein pressure in said port would tend to close said poppet;

a bias element tending to close said poppet; and a restricted passage in said poppet connecting said supply port to said pilot actuation port.

3. The water craft claimed in claim 2 wherein said discharge poppet valve comprises:

a second poppet;

a discharge poppet valve body containing said second poppet;

a discharge port connected to said interconnection point in said discharge poppet valve body leading to said second poppet in a manner wherein pressure in said discharge port would tend to open said second poppet;

an exhaust port connected to said suction of said hydraulic pump in said discharge poppet valve body leading to said second poppet;

a second pilot actuation port connected to said pilot actuation system means in said discharge poppet valve body leading to said second proppet in a manner wherein pressure in said second pilot actuation port would tend to close said second poppet; and a second bias element tending to close said second poppet.

4. The water craft claimed in claim 3 wherein said pilot actuation system means comprises:

a variable orifice valve;

a pilot fluid conduit from said pilot actuation port of the first said supply poppet valves and from said second pilot actuation port of a second said discharge poppet valve which is connected to said interconnection point associated with said first of said supply poppet valves, to an inlet port of said variable orifice valve;

a second pilot fluid conduit from said pilot actuation port of said second supply poppet valve, and from said second pilot actuation port of a first said discharge poppet valve which is connected to said interconnection point associated with said second of said supply poppet valves, to a second inlet port of said variable orifice valve; and a third pilot fluid conduit from a pilot exhaust port on said variable orifice valve to said suction of said hydraulic pump.

5. The water craft claimed in claim 4 wherein said variable orifice valve comprises:

a variable orifice valve body;

a rotatable truncated cylinder which can restrict either said first or said second inlet ports of said variable orifice valve, but can not fully restrict both said inlet ports of said varible orifice valve, and cannot restrict said pilot exhaust port; and a means driven by one of said handles for rotating said cylinder.

6. The water craft claimed in claim 2 wherein said restricted port in said poppet connecting said supply port to said pilot actuation port, is placed so that said restricted passage is partially exposed by said supply poppet valve body when said poppet is in its open position independent of said poppet rotational orientation.

* * * * *